US005584918A

United States Patent [19]

Suzuki et al.

[11] Patent Number: 5,584,918

[45] Date of Patent: Dec. 17, 1996

[54] INK-JET TEXTILE PRINTING INK, PRINTING PROCESS AND INSTRUMENT MAKING USE OF THE SAME, AND PRINTS OBTAINED

[75] Inventors: Mariko Suzuki, Kawasaki; Masahiro Haruta, Tokyo; Shoji Koike, Yokohama; Koromo Shirota, Inagi; Tomoya Yamamoto, Kawasaki, all of Japan

[73] Assignee: Canon Kabushiki Kaisha, Tokyo, Japan

[21] Appl. No.: 589,329

[22] Filed: Jan. 22, 1996

Related U.S. Application Data

[63] Continuation of Ser. No. 175,503, Dec. 30, 1993, abandoned.

[30] Foreign Application Priority Data

Jan. 13, 1993 [JP] Japan ..... 5-004318
Dec. 24, 1993 [JP] Japan ..... 5-326943

[51] Int. Cl.[6] ..... C09D 11/02

[52] U.S. Cl. ..... 106/22 R; 106/22 B

[58] Field of Search ..... 106/22 B, 22 R, 106/22 C

[56] References Cited

U.S. PATENT DOCUMENTS

| | | | |
|---|---|---|---|
| 4,373,954 | 2/1983 | Eida et al. | 106/22 R |
| 5,270,730 | 12/1993 | Yaegashi et al. | 160/20 D |

FOREIGN PATENT DOCUMENTS

| | | |
|---|---|---|
| 0425150 | 5/1991 | European Pat. Off. . |
| 54-059936 | 5/1979 | Japan . |
| 61-231289 | 10/1986 | Japan . |
| 62-283174 | 12/1987 | Japan . |
| 63-168382 | 7/1988 | Japan . |
| 3046589 | 7/1991 | Japan . |
| 2184742 | 7/1987 | United Kingdom . |

*Primary Examiner*—Helene Klemanski
*Attorney, Agent, or Firm*—Fitzpatrick, Cella, Harper & Scinto

[57] ABSTRACT

An ink-jet textile printing ink comprises 5 to 30% by weight of a reactive dye having a vinylsulfone group and/or a monochlorotriazine group and an aqueous liquid medium, wherein the liquid medium contains at least 10 to 2000 ppm of phosphate ion ($PO_4^{3-}$).

4 Claims, 3 Drawing Sheets

INK-JET TEXTILE PRINTING INK, PRINTING PROCESS AND INSTRUMENT MAKING USE OF THE SAME, AND PRINTS OBTAINED

This application is a continuation of application Ser. No. 08/175,503 filed Dec. 30, 1993, now abandoned.

BACKGROUND OF THE INVENTION

1. Field of the Invention

The present invention relates to an ink-jet printing ink suitable for use in conducting textile printing, in particular, on woven or nonwoven fabrics of cotton, silk or the like, which are dyeable with reactive dyes and composed principally of cellulose fibers and/or polyamide fibers, or mixed woven or nonwoven fabrics composed of these fibers and other fibers, and an ink-jet printing process and an instrument making use of the ink.

2. Related Background Art

At present, textile printing is principally conducted by screen printing or roller printing. Both methods are unfit for multi-kind small-quantity production and difficult to quickly cope with the fashion of the day. Therefore, there has recently been a demand for development of an electronic printing system making no use of any plate.

In compliance with this demand, many textile printing processes according to ink-jet recording have been proposed. Various fields expect much from such textile printing processes.

Ink-jet printing inks are required to have the following performance characteristics:

(1) being able to develop the color of ink to a sufficient color depth after conducting washing;

(2) causing no clogging in an ejection orifice;

(3) being able to quickly dry on cloth;

(4) undergoing little irregular feathering on cloth;

(5) undergoing no changes in physical properties and ejection properties and depositing no solid matter in the course of storage; and (6) undergoing no change in ejection properties even in a long-time ejection durability test, and causing neither disconnection nor deposition of foreign matter on a heating head, in particular, in a case of textile printing by a system making use of thermal energy.

In order to satisfy these performance characteristics required, the following means have heretofore been proposed.

First, in order to cope with the requirement (1), it has been generally conducted to make the concentration of a dye sufficiently high. This method is an essential means for using ink droplets as minute as 200 pl or less, or conducting textile printing on a cloth high in absorbing power. However, such an ink causes a problem of thickening due to evaporation of water in the ink and the problem as to the requirement (2) because of deposition of the dye as solid matter.

It has therefore been conducted to add a polyhydric alcohol such as glycerol to an ink in order to cope with the requirement (2). However, this means is not useful if the concentration of a dye contained in the ink exceeds 5%, and hence does not give a satisfactory result except for the case of an extremely specific combination of dye and solvent.

No particular problem is offered to the requirement (3), which is greatly affected by the water repellency of a cloth to be used, so far as a water-based ink is used for a cloth composed mainly of cellulose fibers and/or polyamide fibers.

In order to cope with the requirement (4), many proposals such as addition of, for example, tannin (Japanese Patent Application Laid-Open No. 61-231289) or a carboxyl group-containing polymer (Japanese Patent Application Laid-Open No. 62-283174) to an ink have been made. However, both proposals can not avoid the problems of the requirements (1) and (2) arising from ink.

With respect to the requirements (5) and (6), close investigations have not been conducted under the circumstances because an improvement may be made on the basis of the structure of dye or by additives.

In the field of textile printing, there has been a demand for dyeing cloths of different kinds. However, the optimum composition of an ink varies with individual cloths. More specifically, a dye to be used greatly varies in kind and even fixing conditions thereof depending upon the dyeing mechanism between dye and cloth, which is an ionic bonding, a covalent bonding or a simple diffusion of the dye into fibers. In addition, since polyester and cellulosic fibers considerably differ from each other in affinity for water, the design of the whole liquid medium including additives must be devised if printing is conducted with a water-based ink on cloths formed of such fibers. Accordingly, technical problems required of inks vary little by little depending upon cloths to be printed, so that individual designs are required for inks.

Means capable of satisfying one of the above requirements have been able to be found in the prior art. However, there has not yet been known any printing ink satisfying all the above-mentioned requirements at the same time.

SUMMARY OF THE INVENTION

It is therefore an object of the present invention to provide an ink which satisfies, at the same time, requirements that dyeing bright and high in color depth can be conducted on a cloth comprising cellulose fibers and/or polyamide fibers, short-term and long-term stability is good, dyeing properties remain stable during storage at room temperature, and textile printing can be conducted with high reliability even when the ink is ejected by using thermal energy, and to provide a printing process and an instrument making use of the ink.

Such an object can be achieved by the present invention described below.

According to the present invention, there is thus provided an ink-jet printing ink comprising 5 to 30% by weight of a reactive dye having a vinylsulfone group and/or a monochlorotriazine group and an aqueous liquid medium, wherein the liquid medium contains at least 10 to 2000 ppm of a phosphate ion ($PO_4^{3-}$).

According to the present invention, there is also provided an ink-jet printing process which comprises applying the ink described above to a cloth comprising cellulose fibers and/or polyamide fibers by an ink-jet system, subjecting the cloth to a dyeing treatment and then washing the cloth thus treated.

According to the present invention, there is further provided a recording unit comprising an ink container portion for containing the ink described above therein and an ejection head from which the ink is ejected.

According to the present invention, there is still further provided an ink cartridge comprising an ink container portion for containing the ink described above therein.

According to the present invention, there is yet still further provided an ink-jet recording apparatus comprising the recording unit described above.

According to the present invention, there is yet still further provided an ink-jet recording apparatus comprising a recording head from which the ink described above is ejected, an ink cartridge having an ink container portion for containing the ink therein, and an ink feeder for feeding the ink from the ink cartridge to the recording head.

According to the present invention, there is yet still further provided a print obtained by the ink-jet printing process described above.

According to the present invention, there is yet still further provided a processed article obtained by further processing the print described above.

DESCRIPTION OF THE PREFERRED EMBODIMENTS

Figure 1:
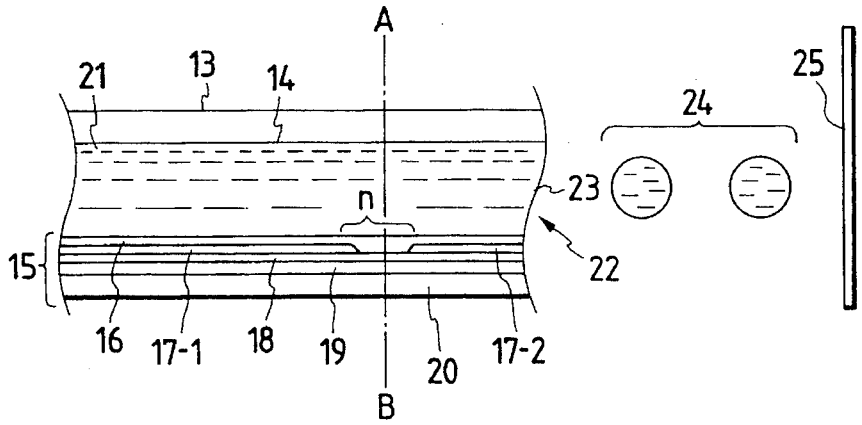
FIG. 1 is a longitudinal cross-sectional view of a nozzle from which an ink is ejected.

The present inventors have carried out improvement in inks with a view toward allowing them to satisfy all the above performance requirements at the same time. As a result, it has been found that when a certain amount of a phosphate ion is contained in an ink comprising a reactive dye having a vinylsulfone group and/or a monochlorotriazine group, the coloring properties of the ink, such as level dyeing ability and color yield, to cloths comprising cellulose fibers and/or polyamide fibers can be improved to a marked extent, its ejection properties remain stable over a long period of time, and the ink undergoes no changes in ejection properties and coloring properties even after being stored for a long period of time, thus leading to completion of the present invention.

These effects were particularly remarkable in the case where an ink-jet head making good use of thermal energy was used.

The reason why the coloring properties have been improved is believed to be as follows. The interaction between dye particles is inhibited in an aqueous liquid medium owing to the presence of the phosphate ion in the certain amount, so that the reactivity on a molecular level of the dye to the fibers is enhanced by leaps and bounds.

The good long-term stabilization of the ejection properties and coloring properties is believed to be attributable to the buffer effect of the phosphate ion and the anti-aggregating effect of the dye.

In the case where a head making good use of thermal energy is used, it has been confirmed that the ink according to the present invention inhibits the accumulation of deposits on a heater of the head.

The concentration of the phosphate ion added to the ink of the present invention is within a range of from 10 to 2000 ppm, preferably from 20 to 1500 ppm, more preferably from 30 to 1000 ppm. The problem of clogging generally apprehended is soluble in a system making use of the dye defined herein upon the application of the phosphate ion to the field of textile printing so long as the concentration falls within this range. More specifically, the phosphate ion are added in the form of a salt. A sodium or ammonium salt may preferably be used.

If the concentration of the phosphate ion is lower than 10 ppm, the ejection properties of the ink may be deteriorated in some cases, to say nothing of the fact that the effect to improve coloring ability is insufficient. In addition, when an ink-jet head making good use of thermal energy is used, heater failure due to cavitation may occur in drive of the order of $1\times10^8$ pulses.

If the concentration of the phosphate ion exceeds 2000 ppm on the contrary, clogging due to the deposition of the phosphate itself may occur near the tip of a nozzle according to the composition of ink in addition to the problem of coloring ability even when the diameter of the nozzle is considerably great. In addition, when the head making good use of thermal energy is used, the accumulation of deposits may occur on a heater of the head in some cases, resulting in ejection failure due to reduction in bubbling force.

The dyes useful in the practice of the present invention are reactive dyes having a vinylsulfone group and/or a monochlorotriazine group. The effects as, described above become remarkable by using the dye having such reactive groups and the phosphate ion. The reason why such a synergistic effect is attained is believed to be as follows. The two reactive groups described above are excellent in strength of reactivity from the viewpoint of balance. For example, a dichlorotriazine group high in reactivity can not achieve the effects of the present invention, while a trichloropyrimidine group low in reactivity can not very well achieve the effects of the present invention. Specific examples of the dyes typically include C.I. Reactive Yellow 2, 15, 37, 42, 76 and 95, C.I. Reactive Red 21, 22, 24, 31, 33, 45, 58, 111, 112, 114, 180, 218 and 226, C.I. Reactive Blue 15, 19, 21, 38, 49, 72, 77, 176, 203 and 220, C.I. Reactive Orange 5, 12, 13 and 35, C.I. Reactive Brown 7, 11, 33 and 46, C.I. Reactive Green 8 and 19, C.I. Reactive Violet 2, 6 and 22, C.I. Reactive Black 5, 8 and 39, and the like, which, however, are not limited.

These dyes may be contained in an ink either singly or in any combination with dyes of different hues. The total amount of the dyes to be used is generally within a range of from 5 to 30% by weight, preferably from 5 to 25% by weight, more preferably from 5 to 20% by weight based on the total weight of the ink. Any amounts less than 5% by weight result in an ink insufficient in color depth. On the other hand, any amounts exceeding 30% by weight result in an ink insufficient in ejection properties.

Water, which is an essential component of the liquid medium for the ink according to the present invention, is used within a range of from 30 to 90% by weight, preferably from 40 to 90% by weight, more preferably from 50 to 85% by weight based on the total weight of the ink.

The above components are essential components for the inks according to the present invention. However, general organic solvents may also be used in combination with water as other components of the liquid medium for the inks. Examples thereof include ketones and keto-alcohols such as acetone and diacetone alcohol; ethers such as tetrahydrofuran and dioxane; addition polymers of oxyethylene or oxypropylene with diethylene glycol, triethylene glycol, tetraethylene glycol, dipropylene glycol, tripropylene glycol, polyethylene glycol, polypropylene glycol and the like; alkylene glycols the alkylene moiety of which has 2 to 6 carbon atoms, such as ethylene glycol, propylene glycol, trimethylene glycol, butylene glycol and hexylene glycol; triols such as 1,2,6-hexanetriol; thiodiglycol; glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; 1,3-dimethyl-2-imidazolidinone; and the like.

The content of the water-soluble organic solvent as described above is generally within a range of from 3 to 60% by weight, preferably from 5 to 50% by weight based on the total weight of the ink.

The liquid medium components as described above may be used either singly or in any combination thereof if used in combination with water. However, preferable compositions of the liquid media are those comprising thiodiglycol, a polymer of oxyethylene or oxypropylene, which has a polymerization degree of 2 to 4, and a mono- or dialkyl ether of the polymer. Among others, a single solvent of thiodiglycol or a mixed solvent system of diethylene glycol and thiodiglycol is particularly preferred.

If the ink as described above is used, the above-described effects of the present invention can be achieved sufficiently. However, it has been found that when polyphosphate ions having a polymerization degree of at least 3 are contained in the ink, coloring properties such as level dyeing ability and color yield can be of course improved in textile printing on the cloths as described above using such an ink and moreover, the resulting print can be prevented from undergoing feathering.

The reason for this is presumed to be as follows. The polyphosphate ion may prevent a dye from migration in a steaming process after the application of the ink to the cloth.

The content of such a polyphosphate ion may preferably be within a range of from 10 to 6000 ppm, more preferably from 10 to 4000 ppm based on the total weight of the ink.

As other ingredients for the aqueous liquid medium, may be added a variety of dispersants; anionic or nonionic surfactants; viscosity modifiers such as polyvinyl alcohol and water-soluble resins; surface tension modifiers such as diethanolamine and triethanolamine; optical whitening agents; pH adjustors including alkali metal ions; mildew-proofing agents; and the like to the inks according to the present invention as needed.

The inks according to the present invention may preferably be used on cloths comprising at least 50% of cellulose fibers and/or polyamide fibers, in particular, cloths comprising at least 50% of cellulose fibers and/or polyamide fibers at least containing an alkaline substance. No particular limitation is imposed on the production process for such cloths. However, the cloths described in Japanese Patent Application Laid-Open No. 63-168382, Japanese Patent Publication No. 3-46589, etc. may be used. Viewed from physical features of fibers and yarn making up a cloth, those long in fiber length, thin in thickness of the yarn and fibers and many in number of them are suitable for the inks of the present invention.

For example, a cloth formed from fibers having an average length of 25 to 60 mm, an average thickness of 0.6 to 2.2 deniers and an average number of twists of 70/cm to 150/cm is preferred in the case of cloth composed mainly of cellulose fibers, and a cloth formed from silk yarn having an average thickness of 14 to 147 deniers composed of fibers having an average thickness of 2.5 to 3.5 deniers in the case of cloth composed mainly of silk fibers as polyamide fibers.

Any pretreatment routinely used may be subjected on the cloths used in this invention as needed. In particular, cloths containing 0.01 to 5% by weight of at least one alkaline substance or 0.01 to 20% by weight of at least one substance selected from the group consisting of water-soluble metal salts, water-soluble polymers, urea and thiourea may preferably be used in some cases.

Examples of the alkaline substance used in the present invention include alkali metal hydroxides such as sodium hydroxide and potassium hydroxide, amines such as mono-, di- and triethanolamines, alkali metal carbonates and bicarbonates such as sodium carbonate, potassium carbonate and sodium bicarbonate, etc. Metal salts of organic acids such as calcium acetate and barium acetate, ammonia and ammonium compounds may also be included. Further, sodium trichloroacetate and the like, which form an alkaline substance by steaming or under dry heat, may also be used. Sodium carbonate and sodium bicarbonate, which are used in dyeing of reactive dyes, are particularly preferred alkaline substances.

Examples of the water-soluble polymers include natural water-soluble polymers such as, for example, starches from corn, wheat and the like, cellulosics such as carboxymethyl cellulose, methyl cellulose and hydroxyethyl cellulose, polysaccharides such as sodium alginate, gum arabic, locust bean gum, tragacanth gum, guar gum and tamarind seed, proteins such as gelatin and casein, tannin and derivatives thereof, and lignin and derivatives thereof.

Examples of synthetic polymers include polyvinyl alcohol type compounds, polyethylene oxide type compounds, water-soluble acrylic polymers, water-soluble maleic anhydride polymers and the like. Of these, the polysaccharide polymers and cellulosic polymers are preferred.

Examples of the water-soluble metal salts include compounds such as halides of alkali metals and alkaline earth metals, which form typical ionic crystals and have a pH of 4 to 10. Representative examples of such compounds include NaCl, $Na_2SO_4$, KCl and $CH_3COONa$ for alkali metals, and $CaCl_2$ and $MgCl_2$ for alkaline earth metals. Of these, salts of Na, K and Ca are preferred.

Further, it is preferable to adjust the water content of the cloth upon textile printing. The water content of the cloth may preferably be adjusted to a 5 to 100 percent increase, more preferably a 6 to 80 percent increase of the official moisture regain (cellulose fiber: 8.5% silk fiber: 12%).

A process in which a cloth is immersed in purified water or an aqueous solution of one of the pretreating agents described above and then squeezed by rollers, and optionally dried is generally used as a method of adjusting the water content, which, however, is not limited.

The water content is determined in accordance with the following equation:

$$\text{Water content (\%)}=\{(W-W')/W''\}\times 100$$

wherein W is a weight of a sample before drying, W' is a weight of the sample after drying, and W" is a weight of the sample after water washing and drying.

The ink prepared in the above-described manner is applied to such a cloth in accordance with an ink-jet recording system.

As the ink-jet recording system, any conventionally-known ink-jet recording system may be used. However, the method described in, for example, Japanese Patent Application Laid-Open No. 54-59936, i.e., a system in which thermal energy is utilized to eject an ink from a nozzle is most suitable for the inks according to the present invention. According to such a system, neither deposition of foreign matter on a heating head nor disconnection occurs even if recording is conducted continuously for a long time. Therefore, textile printing excellent in coloring ability and level dyeing ability can be conducted stably.

As an illustrative example of an apparatus, which is suitable for use in conducting ink-jet printing using the ink according to the present invention, worth mentioning is an apparatus in which thermal energy corresponding to recording signals is applied to an ink within a recording head, and ink droplets are generated in accordance with the thermal energy.

Figure 2:
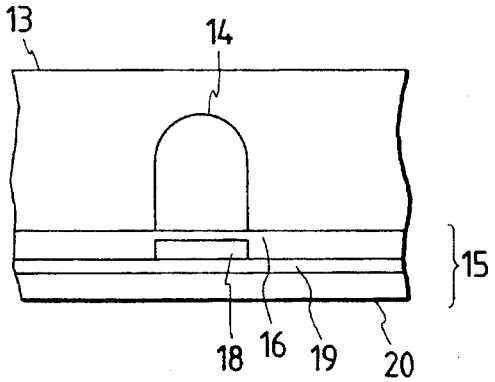
FIG. 2 is a transverse cross-sectional view of the nozzle taken along line A-B of FIG. 1.
Figure 3:
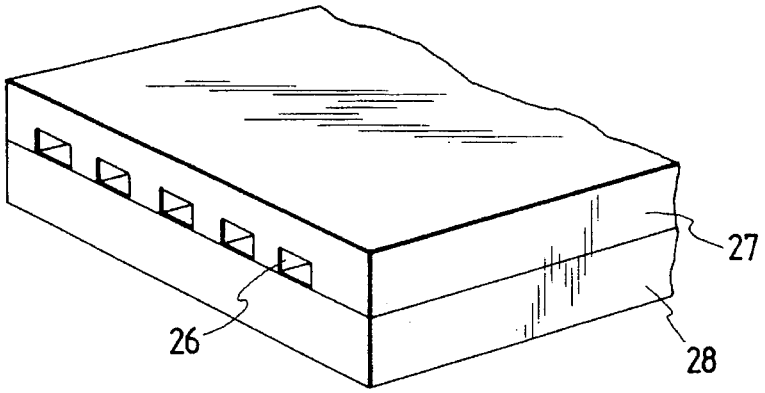
FIG. 3 is a perspective view of the appearance of a multi-nozzles which is an array of such heads as shown in FIG. 1.

Examples of the construction of a head, which is a main component of such an apparatus, are illustrated in FIGS. 1, 2 and 3. FIG. 1 is a longitudinal cross-sectional view of a nozzle of a head for ejecting an ink, and FIG. 2 is a transverse cross-sectional view of the nozzle.

A nozzle 13 is composed of a glass, ceramic or plastic plate or the like having an ink-passing channel 14 and a heating base 15, which is used for thermal recording, said heating base 15 being bonded to the plate. The heating base 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property.

Ink 21 flows to an ejection orifice 22 (a minute opening) and forms a meniscus 23 owing to a pressure P.

Now, upon application of electric signals to the electrodes 17-1, 17-2, the heating base 15 rapidly generates heat at the region shown by n to form bubbles in the ink 21 which is in contact with this region. The meniscus 23 of the ink is projected by the action of the pressure thus produced, and the ink 21 is ejected from the orifice 22 to a cloth 25 comprising cellulose fibers and/or polyamide fibers in the form of recording droplets 24. FIG. 3 illustrates an appearance of a multi-head composed of an array of a number of nozzles as shown in FIG. 1. The multi-head is formed by closely bonding a glass plate 27 having a number of channels 26 to a heating base 28 similar to the base as illustrated in FIG. 1.

Figure 4:
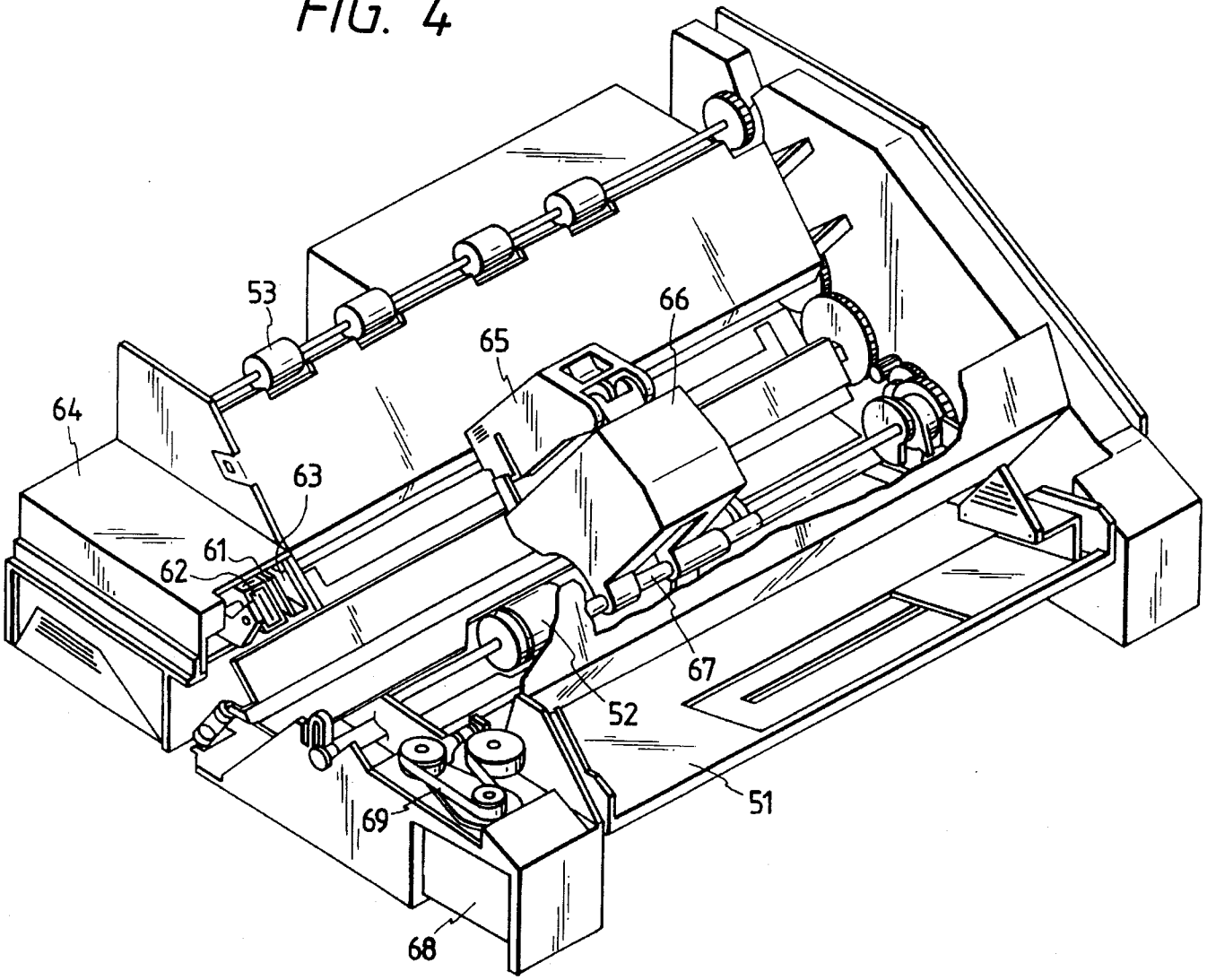
FIG. 4 is a perspective view of an illustrative ink-jet recording apparatus.

FIG. 4 illustrates an example of an ink-jet recording apparatus in which the ink-ejecting head as shown in FIG. 1 or 3 has been incorporated. In FIG. 4, reference numeral 61 designates a blade serving as a wiping member, one end of which is a stationary end held by a blade-holding member to form a cantilever. The blade 61 is provided at the position adjacent to the region in which a recording head operates, and in this embodiment, is held in such a form that it protrudes to the course or path through which the recording head is moved. Reference numeral 62 indicates a cap, which is provided at the home position adjacent to the blade 61, and is so constituted that it moves in the direction perpendicular to the direction in which the recording head is moved and comes into contact with the face of ejection openings to cap it. Reference numeral 63 denotes an absorbing member provided adjoiningly to the blade 61 and, similar to the blade 61, held in such a form that it protrudes to the course through which the recording head is moved. The above-described blade 61, cap 62 and absorbing member 63 constitute a recovery portion 64 for the recording head, where the blade 61 and absorbing member 63 remove water, dust and/or the like from the face of the ink-ejecting openings.

Reference numeral 65 designates the recording head having an ejection-energy-generating means and serving to eject the ink onto a cloth set in an opposing relation with the ejection opening face to conduct recording. Reference numeral 66 indicates a carriage on which the recording head 65 is mounted so that the recording head 65 can be moved. The carriage 66 is slidably interlocked with a guide rod 67 and is connected at its part to a belt 69 driven by a motor 68. Thus, the carriage 66 can be moved along the guide rod 67 and hence, the recording head 65 can be moved from a recording region to a region adjacent thereto.

Reference numerals 51 and 52 denote a cloth feeding part from which the cloths are separately inserted, and cloth feed rollers driven by a motor, respectively. With such construction, the cloth is fed to the position opposite to the ejection opening face of the recording head, and discharged from a cloth discharge section provided with cloth discharge rollers 53 with the progress of recording.

In the above constitution, the cap 62 in the head recovery portion 64 is receded from the moving course of the recording head 65 when the recording head 65 is returned to its home position, for example, after completion of recording, and the blade 61 remains protruded to the moving course. As a result, the ejection opening face of the recording head 65 is wiped. When the cap 62 comes into contact with the ejection opening face of the recording head 65 to cap it, the cap 62 is moved so as to protrude to the moving course of the recording head.

When the recording head 65 is moved from its home position to the position at which recording is started, the cap 62 and the blade 61 are at the same positions as the positions upon the wiping as described above. As a result, the ejection opening face of the recording head 65 is also wiped at the time of this movement.

The above movement of the recording head to its home position is made not only when the recording is completed or the recording head is recovered for ejection, but also when the recording head is moved between recording regions for the purpose of recording, during which it is moved to the home position adjacent to each recording region at given intervals, where the ejection opening face is wiped in accordance with this movement.

Figure 5:
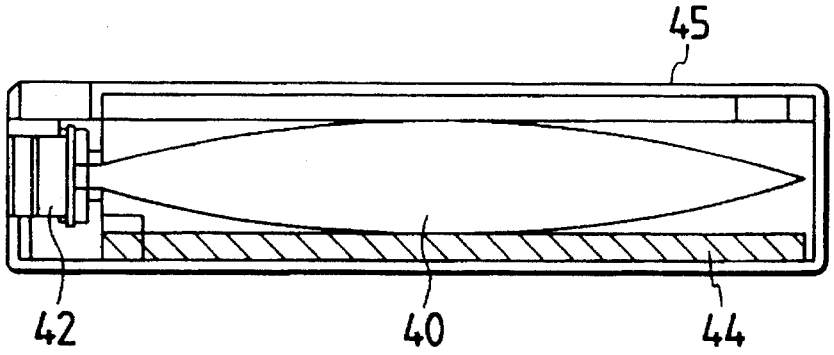
FIG. 5 is a longitudinal cross-sectional view of an ink cartridge.

FIG. 5 illustrates an exemplary ink cartridge in which an ink to be fed to the head through an ink-feeding member, for example, a tube is contained. Here, reference numeral 40 designates an ink container portion containing the ink to be fed, as exemplified by a bag for the ink. One end thereof is provided with a stopper 42 made of rubber. A needle may be inserted into this stopper 42 so that the ink in the bag 40 can be fed to the head. Reference numeral 44 indicates an ink-absorbing member for receiving waste ink. It is preferable for the inks according to the present invention that the ink container portion be formed of a polyolefin, in particular, polyethylene, at its surface with which the ink comes into contact. A device in which these members are integrally formed may also be preferably used.

Figure 6:
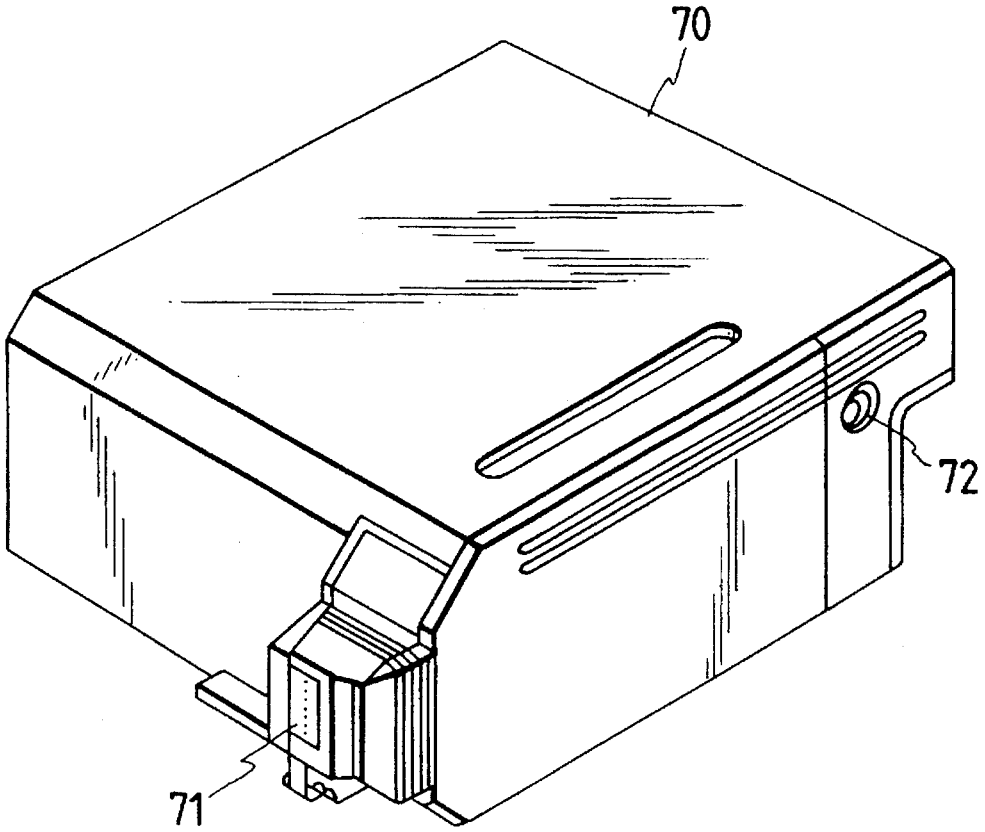
FIG. 6 is a perspective view of a recording unit.

In FIG. 6, reference numeral 70 designates a recording unit, in the interior of which an ink container portion containing ink, for example, and ink-absorbing member, is contained. The recording unit 70 is so constructed that the ink in such an ink container portion is ejected in the form of ink droplets through a head 71 having a plurality of orifices. For the inks of this invention, polyurethane is preferably used as a material for the ink-absorbing member. Reference numeral 72 indicates an air passage for communicating the interior of the recording unit with the atmosphere. This recording unit 70 can be used in place of the recording head shown in FIG. 3, and is detachably installed on the carriage 66.

As conditions under which textile printing particularly high in effect can be carried out with the inks according to the present invention, it is preferred that an ejected ink droplet be within a range of from 20 to 200 pl, a shot-in ink quantity be within a range of from 4 to 40 nl/mm$^2$, a drive frequency be at least 15 kHz, and a head temperature be within a range of from 35°to 60° C.

The printing ink according to the present invention is applied onto a cloth in the above-described manner. However, the ink only adheres to the cloth in this state. Accordingly, the cloth must be subsequently subjected to a process for reactively fixing the dye in the ink to the fibers and a process for removing an unreacted dye. Such reactive fixing and removal of the unreacted dye may be conducted in accordance with any conventionally known methods, for example, a method in which the recorded cloth is treated by a steaming process, an HT steaming process or a thermofix process, or in the case where no alkali-treated cloth is used, an alkaline pad-steam process, an alkaline blotch-steam process, an alkaline shock process or an alkaline cold fix process, and the thus-treated cloth is then washed. In particular, the effects of the present invention can be markedly brought about by the steaming process and the HT steaming process.

The thus-obtained print can be cut into desired sizes as needed, and the cut pieces can then be subjected to processes required to obtain final processed articles, such as sewing, bonding and/or welding, thereby obtaining processed articles such as neckties or handkerchiefs.

EXAMPLES

The present invention will hereinafter be described more specifically by the following Examples and Comparative Examples. Incidentally, all designations of "part" or "parts" and "%" as will be used in the following examples mean part or parts by weight and % by weight unless otherwise expressly noted.

Example 1

Example 1-1

| | |
|---|---|
| Reactive dye (C.I. Reactive Yellow 95) | 10 parts |
| Thiodiglycol | 24 parts |
| Diethylene glycol | 11 parts |
| Monosodium phosphate | 0.06 part |
| Water | 54.9 parts |

After all the above components were mixed, and the mixture was stirred for 2 hours, it was filtered through a "Fluoropore Filter FP-100" (trade name; product of Sumitomo Electric Industries, Ltd.), thereby obtaining Ink (A).

Inks (B) through (F) having their corresponding compositions described below were obtained in the same manner as described above.

Example 1-2

| Ink B: | |
|---|---|
| Reactive dye (C.I. Reactive Red 226) | 10 parts |
| Thiodiglycol | 15 parts |
| Diethylene glycol | 10 parts |

-continued

| Ink B: | |
|---|---|
| Tetraethylene glycol dimethyl ether | 5 parts |
| Disodium phosphate | 0.08 part |
| Water | 59.9 parts |

Example 1-3

| Ink C: | |
|---|---|
| Reactive dye (C.I. Reactive Blue 15) | 13 parts |
| Thiodiglycol | 23 parts |
| Triethylene glycol monobutyl ether | 6 parts |
| Monosodium phosphate | 0.004 parts |
| Sodium tripolyphosphate | 0.01 part |
| Water | 58 parts |

Example 1-4

| Ink D: | |
|---|---|
| Reactive dye (C.I. Reactive Brown 11) | 2 parts |
| Reactive dye (C.I. Reactive Orange 12) | 1.5 parts |
| Reactive dye (C.I. Reactive Black 39) | 6.5 parts |
| Thiodiglycol | 23 parts |
| Diethylene glycol | 5 parts |
| Diethylene glycol | 3 parts |
| Monosodium phosphate | 0.12 part |
| Water | 58.9 parts |

Example 1-5

| Ink E: | |
|---|---|
| Reactive dye (C.I. Reactive Blue 49) | 15 parts |
| Thiodiglycol | 16 parts |
| Diethylene glycol | 17 parts |
| Monosodium phosphate | 0.03 part |
| Disodium phosphate | 0.04 part |
| Sodium tripolyphosphate | 0.05 part |
| Water | 51.9 parts |

Example 1-6

| Ink F: | |
|---|---|
| Reactive dye (C.I. Reactive Red 218) | 15 parts |
| Thiodiglycol | 16 parts |
| Diethylene glycol | 12 parts |
| Tripropylene glycol | 5 parts |
| Monosodium phosphate | 0.05 part |
| Trisodium phosphate | 0.02 part |
| Water | 51.9 parts |

Example 2

Inks A through F obtained in Examples 1-1 through 1-6 and Comparative Inks G through I prepared in accordance with the following respective formulations in the same manner as in Example 1 were separately charged in a head (number of nozzles: 256, ejected ink droplet: 20 to 40 pl) of a "Color Bubble Jet Copier PIXEL PRO" (trade name, manufactured by Canon Inc.) which was an ink-jet recording apparatus making good use of thermal energy to investigate whether clogging of nozzle, reduction in quality of ejected ink and ejection speed, and the like occurred or not when conducting continuous printing of $2\times10^8$ pulses by 10 nozzles.

| | |
|---|---|
| **Ink G:** | |
| Reactive dye (C.I. Reactive Yellow 95) | 10 parts |
| thiodiglycol | 24 parts |
| Diethylene glycol | 11 parts |
| Monosodium phosphate | 0.0008 part |
| Water | 55 parts |
| **Ink H:** | |
| Reactive dye (C.I. Reactive Yellow 95) | 10 parts |
| Thiodiglycol | 24 parts |
| Diethylene glycol | 11 parts |
| Monosodium phosphate | 0.26 part |
| Water | 54.7 parts |
| **Ink I:** | |
| Reactive dye (C.I. Reactive Yellow 1, a dye the reactive group of which is dichlorotriazine) | 10 parts |
| Thiodiglycol | 24 parts |
| Diethylene glycol | 11 parts |
| Monosodium phosphate | 0.06 part |
| Water | 54.9 parts |

Further, English characters and numerals were continuously printed for 3 minutes using the same nozzles as those used above. Thereafter, the nozzles were left unused for 7 days without capping the nozzles to investigate the presence of clogging of the nozzles due to deposition of solid matter near the tip of each nozzle (each nozzle was heated to a temperature range of from 35° to 60° C. prior to its use). Each of Inks A through I in an amount of 100 cc was put into a glass bottle to store it for 20 days at 50° C., thereby investigating its storage stability. The properties and evaluation results of the inks are shown in Table 1.

Further, Inks A through I were charged in a "Color Bubble Jet Copier PIXEL PRO" (trade name, manufactured by Canon Inc.) to conduct printing on a 100% cotton sheet (plain weave fabric, 100% of Egyptian cotton, water content: 15%) pretreated with an alkali and a 100% silk sheet (with 8 monme of habutae, water content: 18%). The print samples thus obtained were fixed by a steaming treatment at 104° C. for 10 minutes. Thereafter, these print samples were washed with a neutral detergent and observed by naked eyes to evaluate them in level dyeing ability. The results are shown in Table 2 (each of the print samples was provided as a solid printed sample of 2×10 cm. under conditions of a shot-in ink quantity of 16 nl/mm$^2$).

Incidentally, all the print samples obtained by using Comparative Inks G through I were poor in color yield compared with those obtained by using Inks A through F containing phosphate ions according to the present invention.

TABLE 1

| Properties | Ink (A) | (B) | (C) | (D) | (E) | (F) | (G) | (H) | (I) |
|---|---|---|---|---|---|---|---|---|---|
| Content of *1 $PO_4^{3-}$ (ppm) | 475 | 535 | 32 | 950 | 505 | 512 | 6.3 | 2058 | 475 |

TABLE 1-continued

| Properties | Ink (A) | (B) | (C) | (D) | (E) | (F) | (G) | (H) | (I) |
|---|---|---|---|---|---|---|---|---|---|
| Ejection*2 stability | A | A | A | A | A | A | C | C | B |
| Deposition*3 on the tip of nozzle | A | A | A | A | A | A | B | C | B |
| Storage*4 stability | A | A | A | A | A | A | C | A | C |

*1: Measured by ion chromotography (100 ppm = 0.01%).

*2: Continuous printing of $2\times10^8$ pulses was conducted by 10 nozzles to determine number of nozzles which did not cause clogging, reduction in quality of ejected ink and ejection speed, etc., whereby each ink was ranked in accordance with the following standard:

A: 10 nozzles;
B: 6 to 9 nozzles;
C: 5 nozzles or less.

*3: After conducting continuous printing for 3 minutes, the nozzles were left over for 7 days without capping the nozzles to observe the state of clogging of the nozzles due to deposition of solid matter near the tip of each nozzle, whereby each ink was ranked in accordance with the following standard:

A: No clogging occurred;
B: Clogging occurred, but was recovered by suction;
C: Clogging was not recovered by suction.

*4: After storing each ink in a glass bottle for 20 day at 50° C., whether foreign matter was generated in the glass bottle or not was observed by naked eyes to evaluate the ink. Further, printing was conducted at a shot-in in quality of 16 nl/mm$^2$ using the stored ink to develop color, thereby comparing its color depth with that of a print sample obtained by using the ink before the storage to rank the ink in accordance with the following standard:

A: No foreign matter generated. There was no difference in color depth between the inks before and after the storage;
B: Foreign matter generated a little. Color depth slightly reduced.
C: Foreign matter greatly generated. Color depth significantly reduced.

TABLE 2

| Cloth | Ink (A) | (B) | (C) | (D) | (E) | (F) | (G) | (H) | (I) |
|---|---|---|---|---|---|---|---|---|---|
| All cotton | A | A | A | A | A | A | C | A | C |
| All silk | A | A | A | A | A | A | C | B | C |

Standard A: Good, B: Somewhat poor, C: Poor.

According to the inks of the present invention, as described above, prints free of ink feathering, bright and high in color depth can be obtained using cloths composed mainly of cellulose fibers and/or polyamide fibers.

Besides, the inks according to the present invention are good in short-term and long-term stability, and their dyeing properties remain unchanged during storage at room temperature.

According to the inks, printing process and instruments of the present invention, further, ink-jet printing can be conducted with high reliability of ejection performance without causing clogging of head nozzles and the like over a long period of time. In particular, the effects of the present invention are brought about markedly in recording of a type that an ink is ejected by the bubbling phenomenon of the ink caused by thermal energy.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. An ink-jet printing ink comprising 5 to 30% by weight of a reactive dye having at least one of a vinylsulfone group and a monochlorotriazine group and an aqueous liquid medium, wherein the liquid medium contains at least 10 to 2000 ppm of a phosphate ion ($PO_4^{3-}$).

2. The ink-jet printing ink according to claim 1, further comprising polyphosphate ions having a polymerization degree of at least 3.

3. An ink-jet printing ink according to claim 1, wherein the phosphate ions are supplied via a sodium salt.

4. An ink-jet printing ink according to claim 1, wherein the phosphate ions are supplied via at least one of disodium phosphate, monosodium phosphate, sodium tripolyphosphate and trisodium phosphate.

* * * * *

UNITED STATES PATENT AND TRADEMARK OFFICE

CERTIFICATE OF CORRECTION

PATENT NO. : 5,584,918

DATED : December 17, 1996

INVENTOR(S) : Mariko SUZUKI, et al.

It is certified that error appears in the above-indentified patent and that said Letters Patent is hereby corrected as shown below:

COLUMN 3:

Line 21, "multi-nozzles" should read --multi-head--, and "heads" should read --nozzles--.

COLUMN 4:

Line 26, "as," should read --as--.

COLUMN 8:

Line 59, "and" should read --and an--.

COLUMN 9:

Line 8, "15" should read --1.5--.

COLUMN 12:

Line 14, "chromotography" should read --chromatography--

Signed and Sealed this

Twelfth Day of August, 1997

Bruce Lehman

*Attest:*

BRUCE LEHMAN

*Attesting Officer*

*Commissioner of Patents and Trademarks*